US005815058A

United States Patent [19]

Gizaw

[11] Patent Number: 5,815,058

[45] Date of Patent: Sep. 29, 1998

[54] CONTACT ENHANCEMENT APPARATUS FOR AN ELECTRIC SWITCH

[75] Inventor: Daniel Gizaw, Blaine, Minn.

[73] Assignee: Onan Corporation, Minneapolis, Minn.

[21] Appl. No.: 832,074

[22] Filed: Apr. 2, 1997

[51] Int. Cl.[6] ..... H01H 67/02

[52] U.S. Cl. ..... 335/132; 335/202; 218/22

[58] Field of Search ..... 335/132, 202, 335/16, 147, 195; 218/22; 200/293–305

[56] References Cited

U.S. PATENT DOCUMENTS

| | | | |
|---|---|---|---|
| 1,516,440 | 11/1924 | Johnson . | |
| 1,720,189 | 7/1929 | Jackson . | |
| 2,306,235 | 12/1942 | Walle . | |
| 2,807,684 | 9/1957 | Ayers . | |
| 2,890,393 | 6/1959 | Coppola . | |
| 2,973,670 | 3/1961 | Dameron . | |
| 2,989,603 | 6/1961 | Mikos et al. . | |
| 3,154,662 | 10/1964 | Heupel et al. . | |
| 3,158,761 | 11/1964 | Bullock . | |
| 3,246,100 | 4/1966 | Russell . | |
| 3,345,485 | 10/1967 | Engel . | |
| 3,430,018 | 2/1969 | Baird . | |
| 3,584,170 | 6/1971 | Bould . | |
| 3,603,755 | 9/1971 | Ranzanigo . | |
| 3,943,416 | 3/1976 | Degenhart . | |
| 4,132,968 | 1/1979 | Lang . | |
| 4,245,140 | 1/1981 | Jencks et al. . | |
| 4,408,111 | 10/1983 | Domhan et al. . | |
| 4,459,445 | 7/1984 | Hisatsune et al. . | |
| 4,489,296 | 12/1984 | Guery et al. | 335/132 |
| 4,650,946 | 3/1987 | Maier et al. . | |
| 4,791,393 | 12/1988 | Flick et al. . | |
| 4,849,590 | 7/1989 | Becker et al. . | |
| 4,855,549 | 8/1989 | Toda et al. . | |
| 4,891,617 | 1/1990 | Beatty et al. | 335/46 |
| 4,891,618 | 1/1990 | Paton . | |
| 4,999,598 | 3/1991 | Jannesari et al. . | |
| 5,004,875 | 4/1991 | Moody et al. . | |
| 5,027,096 | 6/1991 | White et al. . | |
| 5,073,764 | 12/1991 | Takahashi et al. . | |
| 5,089,795 | 2/1992 | Morgan et al. . | |
| 5,296,660 | 3/1994 | Morel et al. . | |
| 5,552,754 | 9/1996 | Sharaf . | |

FOREIGN PATENT DOCUMENTS

| | | |
|---|---|---|
| 1141052 | 1/1969 | United Kingdom . |

*Primary Examiner*—Lincoln Donovan

*Attorney, Agent, or Firm*—Merchant, Gould, Smith, Edell, Welter & Schmidt

[57] ABSTRACT

A contact enforcement apparatus for an electric switch includes two electro-magnetic bars. The first electro-magnetic bar is disposed between a crossbar of the switch and a moveable contact arm. The crossbar carries the moveable contact arm and the first electro-magnetic bar such that the electrical contacts of a stationary contact arm and the moveable contact arm are opened and closed by the crossbar. The second electro-magnetic bar is in U-shape and has a front wall and a back wall, between which the moveable contact arm is at least partially inserted when the electrical contacts are closed together. When a "fault" current passes by the electrical contacts, an attractive force between the electro-magnetic bars is largely increased. This attractive force overcomes a repulsive force caused by the "fault" current which tends to open up the electrical contacts, so that the contact between the moveable and stationary contacts remain closed.

10 Claims, 6 Drawing Sheets

CONTACT ENHANCEMENT APPARATUS FOR AN ELECTRIC SWITCH

FIELD OF THE INVENTION

The present invention relates to an electric switch, more particularly, to a contact enhancement apparatus used in an electric switch to enhance the contact of the electric switch especially when a "fault" current passes by the contact.

BACKGROUND OF THE INVENTION

Various electric switches are well-known and often used to connect and disconnect different power sources and electric loads. Conventional switching devices are disclosed in patents, such as U.S. Pat. No. 3,943,416, issued to Degenhart; U.S. Pat. No. 3,158,761, issued to Bullock; U.S. Pat. No. 3,154,662, issued to Heupel et al.; U.S. Pat. No. 2,973,670, issued to Dameron; U.S. Pat. No. 2,890,393, issued to Coppola; U.S. Pat. No. 5,296,660, issued to Morel et al.

In operation, when an electric switch is in a closed position, electrical contacts of the switch are closed together, so that electricity can be supplied from one power source to the other. However, when a "fault" current occurs in the switch, a huge repulsive force between the electrical contacts caused by the "fault" current forces the switch to be opened. Pre-load springs, which are used to maintain contact between the electrical contacts, are not enough to hold the contacts together. Accordingly, it is desired to design a contact enhancement apparatus for an electric switch which solves this problem.

A recently issued U.S. Pat. No. 5,552,754, issued to the same assignee, Onan Corporation, addressed the similar issue. In this patent, pre-load springs and catches are used to maintain the electrical contacts at a closed position when a "fault" current passes by the contacts. The catches and pre-load springs are likely to be damaged after being used for a period of time.

The present invention provides a new and nonobvious contact enhancement apparatus for the electric switch, which solves these and many other problems associated with existing electric transfer switches.

SUMMARY OF THE INVENTION

The present invention relates to an electric switch, more particularly, to a contact enhancement apparatus used in an electric switch to enhance the contact of the electric switch especially when a "fault" current passes by the contact.

In one embodiment, the present invention comprises a stationary contact arm and a moveable contact arm. The electrical contacts of the moveable and stationary contact arms are electrically connectable to each other. A crossbar carries the moveable contact arm and lifts/lowers the moveable contact arm such that the electrical contacts of the stationary and moveable contact arms are opened and closed by the crossbar. A pre-load spring is disposed between the moveable contact and the crossbar, and the moveable contact arm is spring-biased toward the stationary contact arm when the electrical contacts of the moveable and stationary contact arms are closed together. An electro-magnetic bar is disposed in sandwich between the crossbar and the moveable contact arm, such that the electro-magnetic bar is lifted/lowered along with the crossbar and the moveable contact arm. In addition, the apparatus comprises a U-shaped electro-magnetic bar having a front wall and a back wall being disposed horizontally apart from the stationary contact arm. The moveable contact arm is at least partially inserted between the front and back walls when the electrical contacts of the moveable and stationary contact arms are closed together. An air gap is formed between the electro-magnetic bar and the U-shapes electro-magnetic bar. When an undesired high current, so-called a "fault" current, passes by the contacts, the counter-repulsive force generated by the electro-magnetic bars keeps the contacts together and also allows the contacts to pass such a high current without being destroyed therebetween. Further in one embodiment, the air gap is about 1 millimeter (mm).

Still in one embodiment, the electro-magnetic bars are made of iron, such as Ferro-magnetic materials, or other magnetically conductive materials. The moveable and stationary contact arms are made of copper or other electrical conductive materials. The iron bars allow magnetic field concentrate around the contact arms. The magnetic field creates a counter-repulsive magnetic force between the bars while a current passes through the contact arms. This magnetic force overcomes the repulsive force caused by the "fault" current so as to maintain electrical contacts between the contact arms.

Yet in one embodiment, the electrical contacts of the moveable and stationary contact arms are preferably made of Silver Graphite. Other types of contact materials, such as Silver Tin Oxide and Silver Tungsten, etc., can also be used generally in accordance with the principles of the present invention.

Still in one embodiment, the contact arms and electrical contacts are configured such that they help blow an electric arc away from the contact area because of the electro-magnetic characteristic of the electric arc.

In another embodiment, a U-shaped electro-magnetic bar is disposed between the crossbar and the moveable contact arm. The U-shaped electro-magnetic bar is lifted and lowered along with the crossbar and the moveable contact arm. The moveable contact arm is generally disposed inside the U-shaped electro-magnetic bar between the front and back walls of the U-shaped electro-magnetic bar.

Further in another embodiment, a second electro-magnetic bar is horizontally spaced apart from the stationary contact arm. An air gap is formed between the U-shaped electro-magnetic bar and the second electro-magnetic bar.

In alternative embodiments, the crossbar can be used to carry a plurality of moveable contact arms. Accordingly, a plurality of stationary contact arms each of which has an electrical contact, correspond with the plurality of moveable contact arms, each of which also has a corresponding electrical contact.

These and various other advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters generally indicate corresponding parts throughout the following several views.

DETAILED DESCRIPTION OF THE PREFERRED EMBODIMENT

Figure 1:
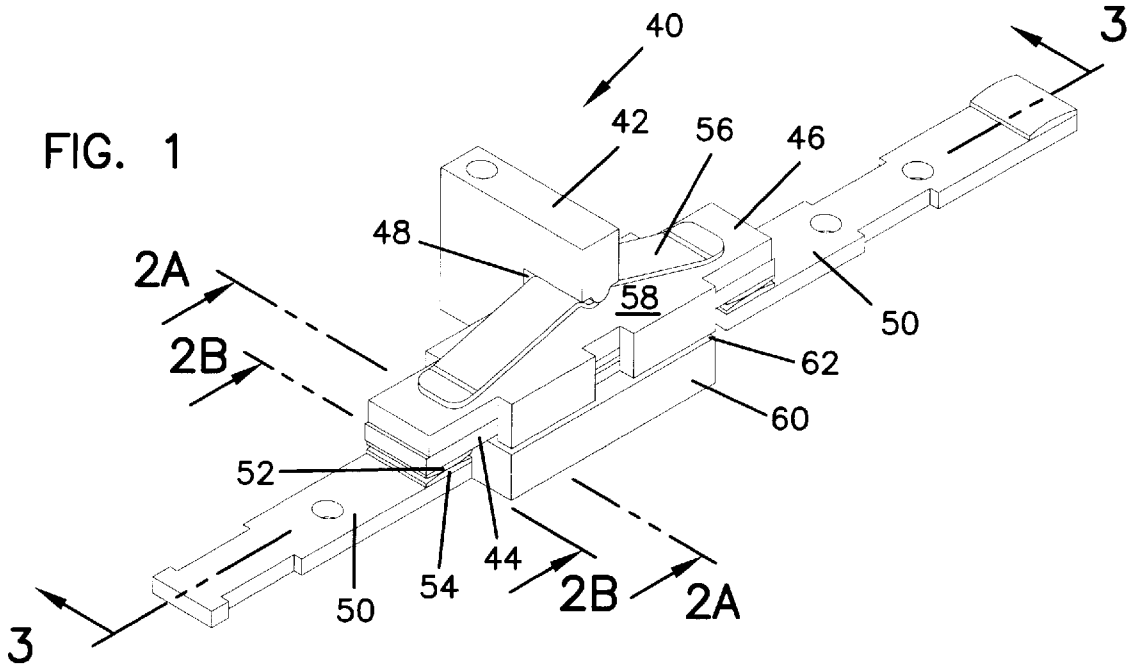
FIG. 1 is perspective view of an embodiment of a contact enhancement apparatus for an electric switch, generally in accordance with the principles of the present invention, with a U-shaped electro-magnetic bar disposed on the top side a moveable contact arm.

Referring now to the drawings in details, wherein like numerals identify similar elements throughout, FIG. 1 shows an embodiment of a contact enhancement apparatus 40 for an electric switch, generally in accordance with the principles of the present invention.

The contact enhancement apparatus 40 includes a crossbar 42. The crossbar 42 carries a moveable contact arm 44 and an electro-magnetic bar 46 which extend through an opening 48 (partially shown in FIG. 1) of the crossbar 42. The moveable contact arm 44 and the electro-magnetic bar 46 are lowered and lifted by the crossbar 42 such that the moveable contact arm 44 connects to or disconnects from a stationary contact arm 50, respectively.

The moveable contact arm 44 has an electrical contact 52 at each end of the moveable contact arm 44. In FIG. 1, two stationary contact arms 50 are shown, each of which has an electrical contact 54 disposed at an end corresponding to the electrical contact 52 of the moveable contact arm 44. Accordingly, when the apparatus 40 is in a closed position, the electrical contacts 52 and 54 of the moveable and stationary contact arms contact to each other, and a current passing through the electrical contacts 52, 54.

A pre-load spring 56, which is disposed between the crossbar 42 and a top surface 58 of the electro-magnetic bar 46, helps maintain the contact between the electrical contacts 52 and 54 in a closed position. The spring can be a leaf spring as shown in FIG. 1, or other types of springs, such as a compression spring, etc., generally in accordance with the principles of the present invention.

Figure 2A:
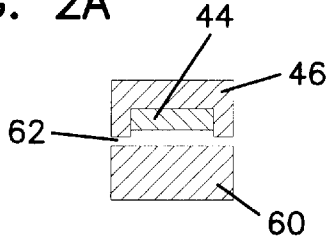
FIG. 2A is a partial, cross-sectional view of the contact enhancement apparatus along line 2A—2A of FIG. 1.
Figure 2B:
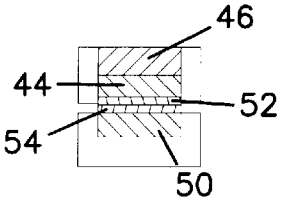
FIG. 2B is a partial, cross-sectional view of the contact enhancement apparatus along line 2B—2B of FIG. 1.

The electro-magnetic bar 46 has a U-shaped cross-section as shown in FIG. 2A, viewing along line 2A—2A of FIG. 1. The moveable contact arm 44 is disposed among top, front, and back walls of the electro-magnetic bar 46.

Figure 3:
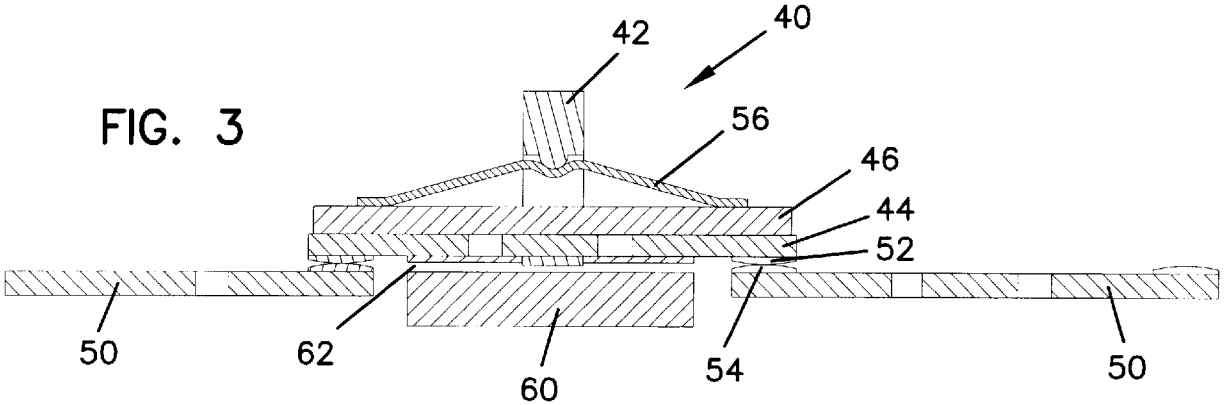
FIG. 3 is a cross-sectional view of the contact enhancement apparatus along line 3—3 of FIG. 1.

As shown in FIGS. 1 and 2A–2C, a second electro-magnetic bar 60 is horizontally spaced apart from the two stationary contact arms 50 and is faced toward the U-shaped electro-magnetic bar 46. An air gap 62 is formed between the second electro-magnetic bar 60 and the U-shaped electro-magnetic bar 46. A desirable size of the air gap 62 is determined by the amount of force required to maintain the contact between the electrical contacts 52, 54. FIG. 3 shows a cross-section view along line 3—3 of FIG. 1, while the apparatus 40 is in a closed position.

Figure 5A:
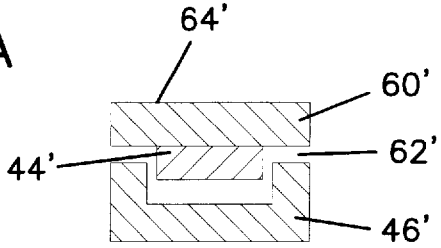
FIG. 5A is a partial, cross-sectional view of the second contact enhancement apparatus along line 5A—5A of FIG. 4A.
Figure 5B:
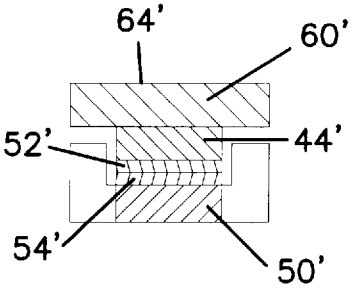
FIG. 5B is a partial, cross-sectional view of the second contact enhancement apparatus along line 5B—5B of FIG. 4A.
Figure 4A:
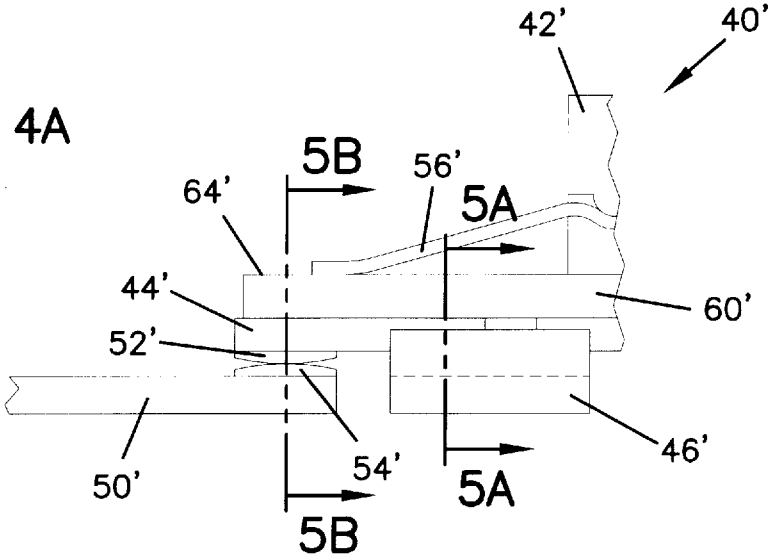
FIG. 4A is a partial, elevational view of a second embodiment of the contact enhancement apparatus, generally in accordance with the principles of the present invention, with a U-shaped electro-magnetic bar disposed on the bottom side of a moveable contact arm.
Figure 4B:
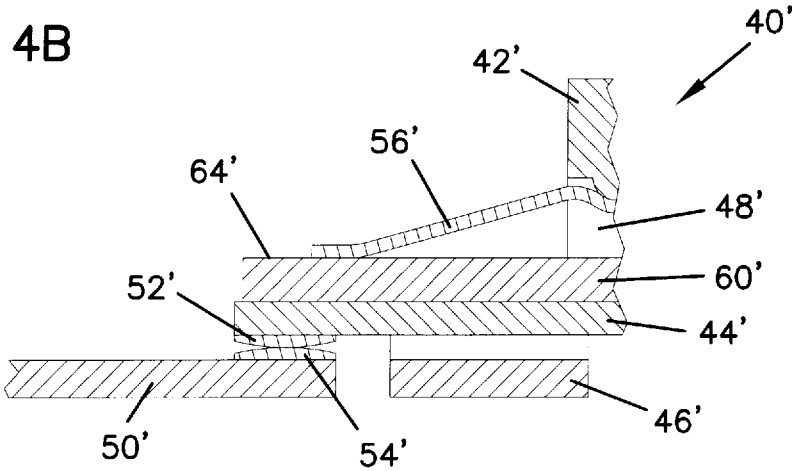
FIG. 4B is a partial, cross-sectional view of the second embodiment of the contact enhancement apparatus.

It is appreciated that other similar configurations can be adapted generally according to the principles of the present invention. In a preferred embodiment (namely, a second embodiment), the U-shaped electro-magnetic bar is disposed on the bottom side of the apparatus as shown in FIGS. 4A, 4B to reduce the amount of load for the crossbar. For illustration purpose, the preferred embodiment uses the reference numerals of the corresponding parts of the first embodiment, but adding a (') behind the corresponding reference numerals. Accordingly, the second electro-magnetic bar 60' is sandwiched between the crossbar 42' with the spring 56' and the moveable contact arm 44', as also shown in FIGS. 5A and 5B. A desirable size of the air gap 62' is similarly formed between the second electro-magnetic bar 60' and the U-shaped electro-magnetic bar 46', which is determined by the amount of force required to maintain the contact between the electrical contacts 52', 54'.

Figure 7:
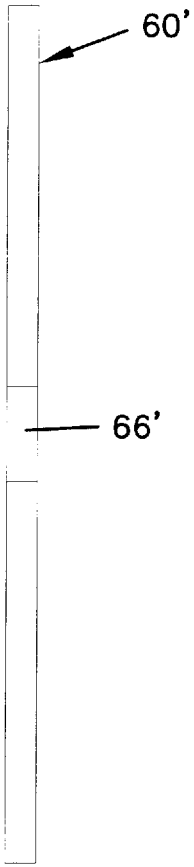
FIG. 7 is an elevational side view of the second electro-magnetic bar.
Figure 6:
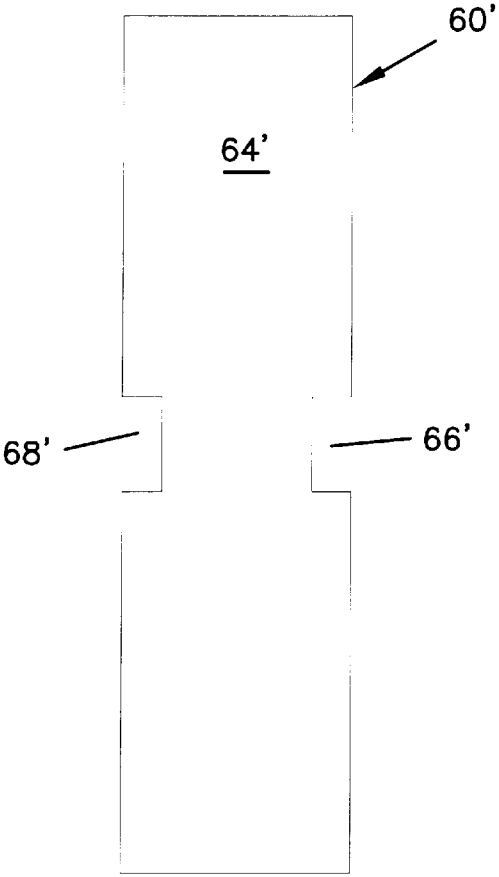
FIG. 6 is a top plane view of a second electro-magnetic bar disposed on the top side of the moveable contact arm in the second embodiment.

In FIGS. 4A–6, the second electro-magnetic bar 60' has a top surface 64' which are spring-biased by the leaf spring 56'. Two side notches 66', 68' are disposed at proximate middle side portions of the bar 60' which allow the crossbar 42' to hold the U-shaped electro-magnetic bar 46'. A side elevational view of the bar 60' is shown in FIG. 7.

Figure 8:
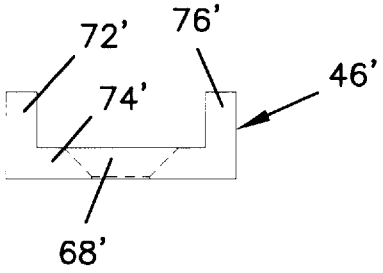
FIG. 8 an elevational side view of the U-shaped electro-magnetic bar.
Figure 9:
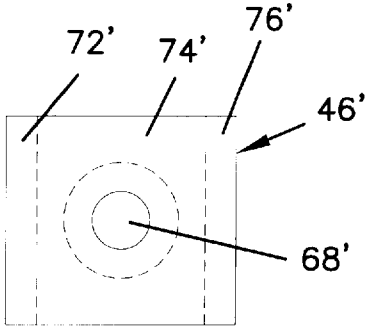
FIG. 9 is a bottom plane view of the U-shaped electro-magnetic bar.

The U-shaped electro-magnetic bar 46' of the preferred embodiment is shown in FIGS. 8 and 9. The electro-magnetic bar 46' includes front, back, and bottom walls 72', 74', 76' into which at least part of the moveable contact arm 44' is inserted (see in FIGS. 5A–5C). A through opening 68' is disposed at approximately the center of the bottom wall 74' of the bar 46'. One purpose of having the through opening 68' is to readily access the inside of the U-shaped electro-magnetic bar 46'.

Figure 2C:
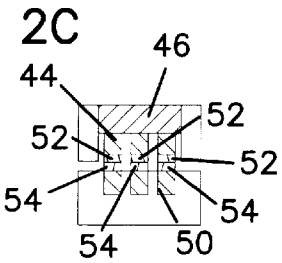
FIG. 2C is a partial, cross-sectional view of an alternative embodiment of the contact enhancement apparatus along line 2B—2B of FIG. 1.
Figure 5C:
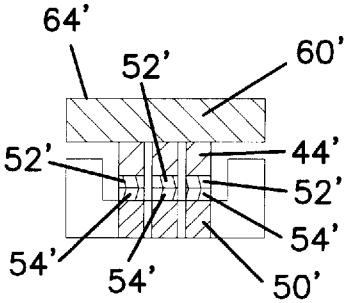
FIG. 5C is a partial, cross-sectional view of an alternative embodiment of the second contact enhancement apparatus along 5B—5B of FIG. 4A.

In FIGS. 2C and 5C, a plurality of moveable and stationary contact arms 44(44'), 50(50') are shown. The crossbar 42(42') carries the moveable contact arms 44(44') to connect/disconnect the electrical contacts 52(52') to/from the corresponding electrical contacts 54(54') of the stationary contact arms 50(50').

Figure 13:
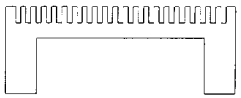
FIG. 13 is an elevational side view of an alternative embodiment of the U-shaped electro-magnetic bar.

In addition, alternative embodiments of the electro-magnetic bar 46(46') can be used. For instance, the electro-magnetic bar 46(46') can be laminated for lower loss or finned for heat dissipation, an example of which is shown in FIG. 13.

Figure 10:
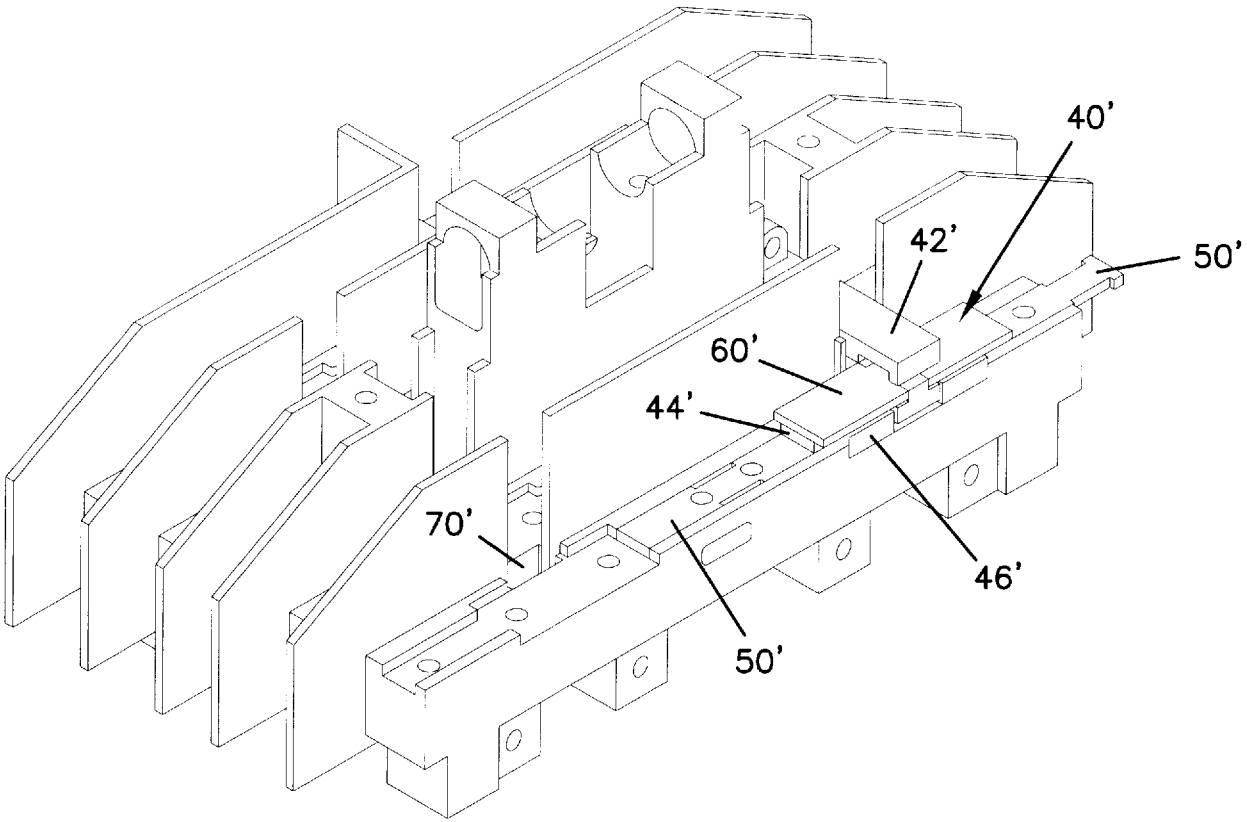
FIG. 10 is a perspective view of the second embodiment of the contact enhancement apparatus used in an electric switch assembly.

FIG. 10 shows a perspective view of the preferred embodiment (second embodiment) of the contact enhancement apparatus 40' mounted in an electric switch assembly. At space 70', an additional apparatus 40(40') can be mounted in the electric switch assembly. It is appreciated that the present apparatus 40 or 40' can be used in other types of electric switch assemblies.

Figure 11:
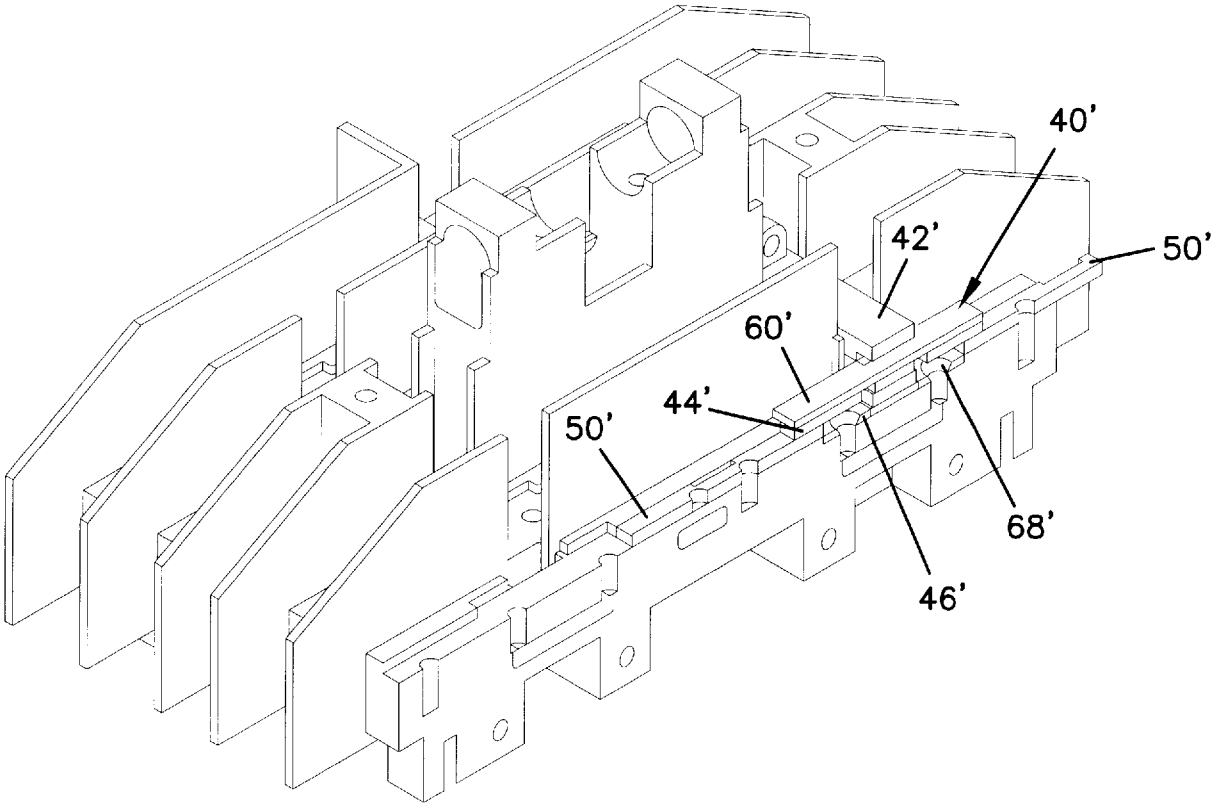
FIG. 11 is a perspective view of the second embodiment of the contact enhancement apparatus shown in FIG. 10, with a longitudinal section being removed for illustration.
Figure 12:
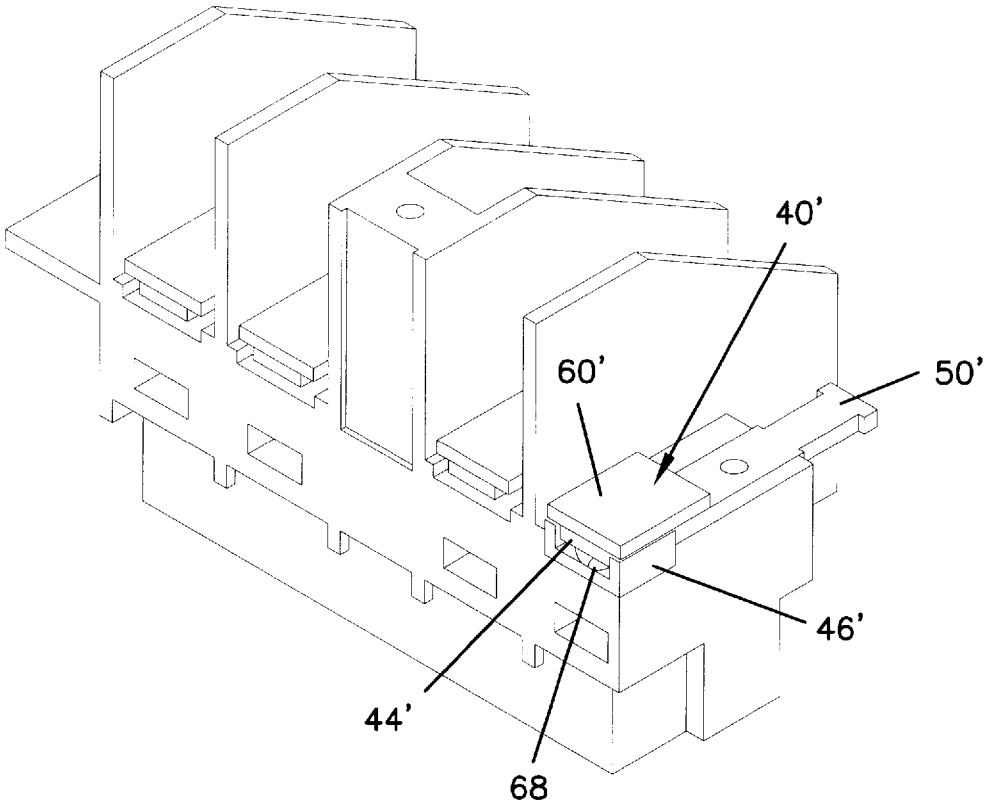
FIG. 12 is a perspective view of the second embodiment of the contact enhancement apparatus shown in FIG. 10, with a transversal section being removed for illustration.

In FIG. 11, a longitudinal section of the electric switch assembly and its mounted contact enhancement apparatus 40' of FIG. 10 are removed for illustration. In FIG. 12, a transversal section of the electric switch assembly and its mounted contact enhancement apparatus 40' are removed for illustration.

Figure 14:
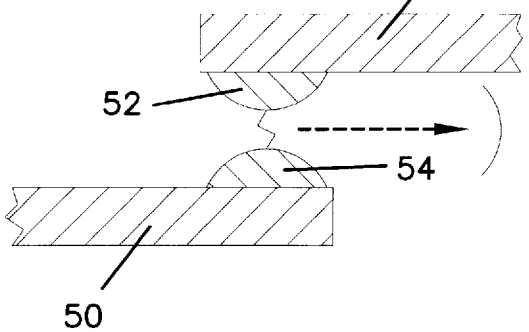
FIG. 14 is an enlarged view of a contact area between stationary and moveable contact arms.

As shown in FIG. 14, the contact arms 44, 50 and electrical contacts 52, 54 can be configured such that they can help blow an electric arc away from the contact area because of the electro-magnetic characteristic of the electric arc.

In the first embodiment and the preferred embodiment (the second embodiment), the air gaps 62, 62' are about 1 millimeter (mm). It is appreciated that the size of the air gap can be varied generally in accordance with the principles of the present invention.

The electro-magnetic bars 60, 60' and the U-shaped electro-magnetic bars 46, 46' are made of iron, such as ferro-magnetic materials, or other permanent magnetic materials, etc. The moveable and stationary contact arms 44, 44' and 50, 50' are made of copper or copper alloy, etc. The electrical contacts 52, 52' and 54, 54' of the moveable and stationary contact arms are preferably made of Silver Graphite (AgC, for example, 95.5% silver, 4.5% Carbon). It is appreciated that other types of suitable materials, such as Silver Tin Oxide (AgSnO), Silver Tungsten (AgWNi), etc., can be used for contact materials.

It is appreciated that the electro-magnetic bar 46(46') can be configured in other shapes, such as a C-shape, etc., in accordance with the principles of the present invention.

In a normal operation, when an electric switch is closed, the electrical contacts 52(52') and 54(54') are forced to contact to each other by the crossbar 42(42') and the pre-load spring 56(56'). When a "fault" current passes by the electrical contacts, a repulsive force is generated which tends to separate the electrical contacts from each other. The separation would cut off the electricity path so as to cause an open circuit. In addition, a huge electric spike or arc caused by the separation would likely damage the electrical contacts. In the present invention, the contact enhancement apparatus 40(40') generates a counter-repulsive force so that the electrical contacts maintain contact to each other. Specifically, when a "fault" current occurs, an attractive force between the electro-magnetic bars 46(46') and 60(60') is largely increased. This attractive force overcomes or, at least, counters the repulsive force caused by the "fault" current which tends to open up the electrical contacts. Accordingly, the contact between the moveable and stationary electrical contacts remain closed.

It will be appreciated that alternate embodiments in keeping with the principles of the present invention might be utilized. It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts, within the principles of the invention, to the full extent indicated by the broad general meaning of the terms in which the appended claims are expressed.

What is claimed is:

1. A contact enhancement apparatus for an electric switch, comprising:

a stationary contact arm having at least one electrical contact;

a moveable contact arm having at least one electrical contact, the electrical contacts of the moveable and stationary contact arms being electrically connectable to each other;

a crossbar carrying the moveable contact arm and lifting and lowering the moveable contact arm such that the electrical contacts of the stationary and moveable contact arms are connected and disconnected to and from each other by the crossbar;

a spring being disposed between the moveable contact and the crossbar, the moveable contact arm being spring-biased toward the stationary contact arm by the spring when the electrical contacts of the moveable and stationary contact arms are connected to each other;

an electro-magnetic bar being disposed in sandwich between the crossbar and the moveable contact arm, such that the electro-magnetic bar is lifted and lowered along with the crossbar and the moveable contact arm; and a U-shaped electro-magnetic bar being horizontally spaced apart from the stationary contact arm, the moveable contact arm being at least partially insertable inside the U-shaped electro-magnetic bar when the electrical contacts of the moveable and stationary contact arms are connected to each other, an air gap being formed between the electro-magnetic bar and the U-shaped electro-magnetic bar.

2. A contact enhancement apparatus according to claim 1, wherein the air gap is about 1 millimeter (mm).

3. A contact enhancement apparatus according to claim 1, wherein the electro-magnetic bars are made of iron.

4. A contact enhancement apparatus according to claim 1, wherein the moveable and stationary contact arms are made of copper.

5. A contact enhancement apparatus according to claim 1, wherein the electrical contacts of the moveable and stationary contact arms are made of Silver Graphite.

6. A contact enhancement apparatus for an electric switch, comprising:

a stationary contact arm having at least one electrical contact;

a moveable contact arm having at least one electrical contact, the electrical contacts of the moveable and stationary contact arms being electrically connectable to each other;

a crossbar carrying the moveable contact arm and lifting and lowering the moveable contact arm such that the electrical contacts of the stationary and moveable contact arms are connected and disconnected to and from each other by the crossbar;

a spring being disposed between the moveable contact and the crossbar, the moveable contact arm being spring-biased toward the stationary contact arm by the spring when the electrical contacts of the moveable and stationary contact arms are connected to each other;

a U-shaped electro-magnetic bar being disposed between the crossbar and the moveable contact arm, the U-shaped electro-magnetic bar being lifted and lowered along with the crossbar and the moveable contact arm, the moveable contact arm being disposed inside the U-shaped electro-magnetic bar; and a second electro-magnetic bar being horizontally spaced apart from the stationary contact arm, an air gap being formed between the second electro-magnetic bar and the U-shaped electro-magnetic bar.

7. A contact enhancement apparatus according to claim 6, wherein the air gap is about 1 millimeter (mm).

8. A contact enhancement apparatus according to claim 6, wherein the electro-magnetic bars are made of iron.

9. A contact enhancement apparatus according to claim 6, wherein the moveable and stationary contact arms are made of copper.

10. A contact enhancement apparatus according to claim 6, wherein the electrical contacts of the moveable and stationary contact arms are made of Silver Graphite.

* * * * *